United States Patent [19]

Rampe

[11] 4,091,575

[45] May 30, 1978

[54] BOWL-TYPE VIBRATORY FINISHING MACHINE

[75] Inventor: John F. Rampe, Mayfield Heights, Ohio

[73] Assignee: Rampe Research, Cleveland, Ohio

[21] Appl. No.: 714,823

[22] Filed: Aug. 16, 1976

[51] Int. Cl.[2] ..... B24B 31/06

[52] U.S. Cl. ..... 51/163.2

[58] Field of Search ..... 51/163.1, 163.2

[56] References Cited

U.S. PATENT DOCUMENTS

| | | | |
|---|---|---|---|
| 3,179,343 | 4/1965 | Sherwen | 241/175 |
| 3,268,177 | 8/1966 | McKibben | 241/175 |
| 3,449,869 | 6/1969 | Rampe | 51/163.1 |
| 3,484,998 | 12/1969 | McKibben | 51/163.2 |
| 3,538,651 | 11/1970 | Rampe | 51/163.1 |
| 3,693,228 | 9/1972 | Ferrara | 29/56.6 |
| 3,708,918 | 1/1973 | Pool | 51/163.2 |
| 3,877,178 | 4/1975 | Campanelli | 51/163.2 |
| 3,891,191 | 6/1975 | Choules et al. | 366/111 |
| 3,893,266 | 7/1975 | Anderson | 51/163.2 |
| 3,991,524 | 11/1976 | Ferrara | 51/163.1 |

FOREIGN PATENT DOCUMENTS

| | | | |
|---|---|---|---|
| 1,652,154 | 5/1970 | Germany | 51/163.2 |

*Primary Examiner*—Harold D. Whitehead
*Attorney, Agent, or Firm*—David A. Burge Co.

[57] ABSTRACT

A vibratory finishing machine has a bowl structure supported by shear-loaded elastomeric mounts, and a drive system for vibrating the bowl structure about a node or null point located along a vertical center axis of the bowl structure. Each of the elastomeric mounts has one portion secured to the bowl structure, and another portion secured to a base structure. The one and another portions define an axis of each mount, and the mounts are arranged such that their axes intersect the center axis at the node or null point. The bowl structure is provided with a resilient liner assembly formed from clamped-together, individually replaceable, resilient liner components. A discharge opening is provided in the bottom of one of the liner components and is selectively closed by either a solid plug or a plug having openings formed therethrough to continually drain liquids and strain fines from the chamber defined by the liner assembly.

47 Claims, 6 Drawing Figures

BOWL-TYPE VIBRATORY FINISHING MACHINE

REFERENCE TO RELEVANT PATENTS

Clamping Means For Tub Liners, U.S. Pat. No. 3,538,651 issued Nov. 10, 1970 to J. F. Rampe, here the "Replaceable Liner Patent".

Tub With Removable Strainer Plug For Vibratory Finisher, U.S. Pat. No. 3,231,093 issued Jan. 25, 1966 to J. F. Rampe, here the "Plug Patent".

Molded Plastic Pulley With Heat Conducting Metal Lining, U.S. Pat. No. 3,142,997 issued Aug. 4, 1964 to J. F. Rampe, here the "Pulley Patent".

BACKGROUND OF THE INVENTION

1. Field of the Invention

The present invention relates generally to vibratory finishing machines, and more particularly to a novel and improved bowl-type vibratory finishing machine.

2. Prior Art

Many surface finishing operations such as deburring, burnishing, descaling, cleaning and the like can be conducted expeditiously in a vibratory finishing machine. Such a machine includes a movably mounted receptacle and a drive system for vibrating the receptacle. Workpieces to be finished are loaded into the receptacle together with finishing media. A finishing action is imparted to the workpieces by vibrating the receptacle so that the mixture of workpieces and media is effectively maintained in a fluid or mobile state with smaller components of the mixture dispersed between large components for impact. Impulse forces imparted to the mixture not only cause repeated impacts among its components but also cause the mixture to churn in a predictable manner as a finishing process is carried out.

Two basic types of vibratory finishing machines are in common use. One type employs an elongated, substantially horizontally disposed receptacle which is vibrated by eccentrics rotating about horizontal axes paralleling the length of the receptacle. This first type of machine is known in the art as a "tub-type machine" or simply "tub machine", and its receptacle is commonly called a "tub". Another type uses a substantially annular receptacle which is vibrated by rotating one or more eccentrics about a vertical "center axis" located centrally of the receptacle when the receptacle is at rest. This latter type of machine is known in the art as a "bowl-type machine" or simply "bowl machine", and its receptacle is commonly called a "bowl". While tub and bowl machines have many similar characteristics, they are sufficiently different in arrangement and operation that one will frequently offer advantages over the other in solving a particular finishing problem. The present invention relates to bowl-type machines.

During operation of a bowl machine, the bowl vibrates in gyratory movements about a node or null point located somewhere along the machine's center axis. This gyratory movement subjects the bowl's contents to a complex of vertical, radial and tangential impulse components which are intended to effect a uniform dispersion of the smaller components of the workpiece and media mixture among the large components of the mixture for impact. The resultant impulses are so oriented and timed as to cause both circumferential precession of the mixture and rotation of the mixture in essentially radiating vertical planes.

Those skilled in the art maintain different and conflicting theories on where the node or null point should be located along the center axis. Some maintain that the node or null point should be located within or near a horizontal plane which includes the center of gravity of the bowl's contents. This arrangement effectively minimizes horizontal impulse components imparted to the bowl's contents and maximizes the vertical components. Others maintain that a node or null point location slightly below the bottom of the bowl's chamber is desirable since it gives something of a mix of vertical, horizontal and tangential components. Still others advocate higher and lower node or null point locations.

Those skilled in the art similarly advance different and conflicting theories on the number of eccentrics which should be used to vibrate the bowl, the locations of the eccentrics, and the relative orientations of the eccentrics where more than one is used. Still other theories obtain on how and where a drive motor should connect with the eccentrics.

Factors such as node or null point location, the number, location and arrangement of eccentrics, and features of the drive motor connection all intertwine to determine such other factors as:

(a) the simplicity or complexity of the machine;

(b) the ease with which the machine can be serviced and such parts as bearings replaced;

(c) the longevity of service which can be expected from the machine;

(d) the sensitivity of the machine to different bowl loadings, i.e. whether it can handle a wide range of large and small, heavy and light loads; and (e) the type of vibratory movement which is imparted to the bowl, which, in turn, determines such things as:

(i) the type of circulation movement which will be executed by a mixture of media and workpieces in the bowl;

(ii) the direction and rate of precession of the mixture; and (iii) the effectiveness of the resulting finishing action in terms of quality and time required to carry it out.

Previous proposals made in an effort to optimize these factors have resulted in machines which are relatively complex and difficult to service. The need for frequent bearing replacement has been a continuing problem, and the construction of many such machines has made bearing replacement difficult. Most bowl machines are quite sensitive to changes in bowl loading and operate effectively only in a relatively narrow loading range.

Most vibratory finishing machines are provided with a lining which prevents metal workpieces from impacting on the metal shell of the receptacle. Inasmuch as the lining material is abraded away during extensive machine use, replaceable liners have been proposed. A problem encountered in the use of replaceable liners is that of clamping and holding them securely in position so that they do not shift or separate from the receptacle shell under the influence of extensive vibration. A solution which has successfully solved this problem in tub-type machines is described in the referenced Replaceable Liner Patent.

Bowl-type machines present peculiar lining problems not found in tub-type machines. Whereas tub machines have elongated tubs of relatively simple configuration, bowl machines have relatively complex, torroidal-shaped bowls. Molding a replaceable, torrus shaped liner is difficult and expensive. Moreover, an acceptable solution is not found in prior proposals to the problem of adequately clamping a torrus shaped liner in place so that it will withstand extensive vibrations without employing a structure which significantly complicates liner replacement.

Most bowl machine proposals use a cast-in-situ liner which requires extensive machine disassembly and replacement of the bowl's shell when a liner is to be changed. The expanse and effort and lengthy downtime required to replace bowl machine liners is, in fact, one of the major drawbacks whih influence purchasers to buy a tub-type machine when a bowl-type machine might better serve their needs.

The use of a strainer plug which cooperates with a receptacle liner to close portions of a drain opening formed in the bottom of the liner is described in the referenced Plug Patent. The described drain closure system includes a strainer plug carried by the liner itself, and a closure plug which is clamped against the underside of the machine's metallic receptacle. Both of the plugs must be removed if one is to fully open the drain opening. While the described system operates quite efficiently as a drain for fluids and as a strainer to remove fines, it is not well adapted to serve as a means of discharging finishing media from the receptacle due to the difficulty one would have in removing the strainer plug from the liner in the presence of such media.

SUMMARY OF THE INVENTION

The present invention overcomes the foregoing and other drawbacks of prior proposals by providing a novel and improved bowl-type vibratory finishing machine.

Bowl-type machines embodying the preferred practice of the present invention provide a combination of features that are unique to the industry. The machine is of simple, relatively inexpensive construction. It has a relatively simple but rugged base structure, an equally simple and rugged bowl structure, and utilizes highly durable elastomeric mounts to support the bowl structure on the base structure. It has a simple drive system configured to permit ready access to a drive system bearing which requires most frequent service. It provides a novel, multi-part resilient tub liner assembly with liner components which are simple to mold, easy to install and remove, and which may be individually replaced as required. And it provides a multi-function drain closure and plug assembly of simple construction for selectively closing at least a portion of a discharge opening formed in the bottom of one of the liner components.

A significant feature of the present inventin lies in its novel arrangement of elastomeric mounts. Each mount has one portion secured to the base structure and another portion secured to the bowl structure. The one and another portions define an axis for each mount, and the mounts are arranged such that their axes intersect at a common point along the machine's center axis. The machine's drive system is arranged to vibrate the bowl about a node or null point which coincides with this common point. The arrangement of mounts assures that forces imposed on the mounts by the weight of the bowl structure and its contents load the mounts in shear, i.e. in planes normal to their axes. When arranged and loaded in this manner, the mounts tend to resiliently oppose movements of the bowl structure in any mode other than about the desired node or null point. As a result, the machine is found to be substantially less sensitive to variations in receptacle loading than are other, previously proposed bowl-type machines. A single machine can, for example, handle bowl load volumes within as large a range as 2 cubic feet to 6 cubic feet, and is operable to impart a good finishing action to the load anywhere within this very broad range.

The drive system includes a pair of eccentrics which are supported on a rotatable shaft journaled by the bowl structure. The shaft rotates about the center axis of the machine and carries a drive pulley at the location of the node or null point. A motor is carried on the base structure and is connected by a drive belt to the drive pulley. The belt extends in a plane which is normal to the machine's center axis and which includes the node or null point. This arrangement assures that belt tension remains substantially constant despite relative movements between the bowl structure and the base structure, and assures that the belt is subjected to minimal extraneous loadings.

A feature of the drive system lies in the relative locations it employs for two bearings which journal the eccentric mounting shaft. Inasmuch as it is difficult to provide easy service access to both bearings, the more accessible of the two bearings is positioned so that it transmits the majority of the vibrational force to the bowl structure. More specifically, the lowermost of the two bearings, i.e. the one which is least accessible, is located quite near the node or null point so that it is subjected to relatively light loadings and will accordingly require minimal service. The upper and more accessible of the two bearings is located a substantial distance from the node and is therefore responsible for transmitting relatively large vibrational forces to the bowl structure. A removable cover on the top of the bowl structure provides ready service access to the upper bearing.

Thw bowl structure includes an upstanding, cylindrical center tube, an annular plate which is positioned around and welded to the center tube, and an upstanding cylindrical side wall which is welded to the periphery of the annular plate. These three comonents define an annular, upwardly opening trough, the inner rim of which is formed by the upper end of the center tube, and the outer rim of which is formed by the upper end of the side wall.

The liner assembly departs in several significant ways from traditional approaches to providing a removable receptacle liner. It utilizes a three-part assembly of relatively easy to mold components which can be individually replaced as required. It provides underlying support structure for only one of the three components and utilizes a cantilever-like mount for the othr two components. And it utilizes the cantilever-supported components in a unique and highly effective manner to clamp the other component in place.

More specifically, the liner assembly includes a semi-torroidal shaped floor member which is positioned in the annular trough defined by the bowl structure, and which forms the floor of an annular, upwardly facing, finishing chamber. Inner and outer rim extension members rest, respectively, atop inner and outer rim portions of the floor member, and are clamped downwardly at a location near their juncture with the floor member. The downwardly directed clamping forces which are imposed on the upstanding walls of the floor member force the floor member tightly into engagement with the walls and floor of the underlying trough structure. This approach to clamping a bowl machine liner in place is found to succeed in the presence of heavy loadings and vibrations where other proposals have failed.

A feature of the liner assembly is that its components can be individually replaced as needed. Since the semi-torroidal shaped floor member is subject to more wear than are the other two liner members, it alone can be replaced at relatively low cost when needed.

A further feature of the present invention lies in its use of nothing more than the resilient inner and outer extension members to form upper portions of finishing chamber. Such an arrangement is desirable from the viewpoint of safety in that it provides a bowl structure, the upper portion of which is resilient and has no sharp edges. It is also desirable from the viewpoint of eliminating the cost involved in providing a metal shell around upper portions of the liner as in previous proposals.

Still another feature of the liner construction lies in the outer configuration of the semi-torroidal-shaped floor member. Outside surface portions of the floor member are relieved such that they make contact with the surrounding metal bowl-structure in only three areas: (1) along the inner rim; (2) along the outer rim: and (3) along a circle which extends beneath the center of the finishing chamber. This three-location contact is not only important in achieving proper clamping of floor member but also serves to reduce frictional forces encurred in installing, removing and replacing liner floor members. Stated in another way, it makes the floor members easier to install and remove.

A further feature of the multi-part liner construction is that the inner and outer liner members can be omitted where it is desired to provide a relatively small capacity machine. Clamping means having a lesser height than the inner and outer liner members can be installed atop the rims of the floor members to effect its proper clamping on small capacity machine installations.

Machines embodying the preferred practice of the present invention are provided with a combination drain and discharge opening which communicates with the bottom of the finishing chamber. The opening extends through the floor member of the liner assembly and widens in the discharge direction. A tapered plug structure is provided for selectively closing the opening, and a clamping structure, somewhat like that described in the referenced Plug Patent, is employed to hold the plug in place. Interchangeable plugs provided with different sized strainer openings can be used to continuously drain liquids from the finishing chamber and to continuously strain out fines.

As will be apparent from the foregoing summary, it is a general object of the present invention to provide a novel and improved bowl-type vibratory finishing machine.

These and other objects and a fuller understanding of the invention described and claimed in the present application may be had by referring to the following description and claims taken in conjunction with the accompanying drawings.

DESCRIPTION OF THE PREFERRED EMBODIMENT

Figure 1:
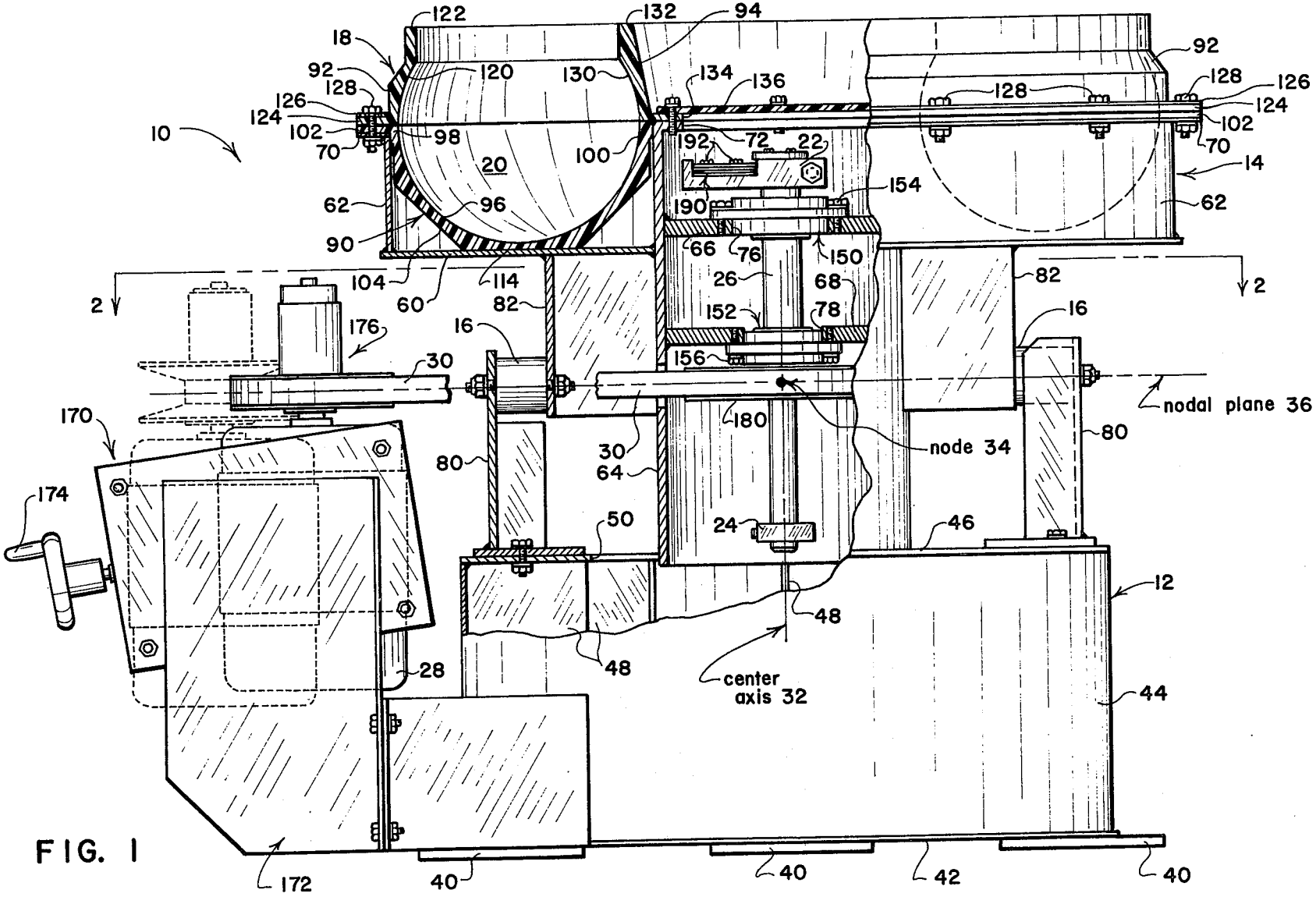
FIG. 1 is a side elevational view of a bowl-type vibratory finishing machine with portions broken away and shown in cross-section, and with one extreme position of a drive motor and variable speed pulley being shown in phantom.
Figure 2:
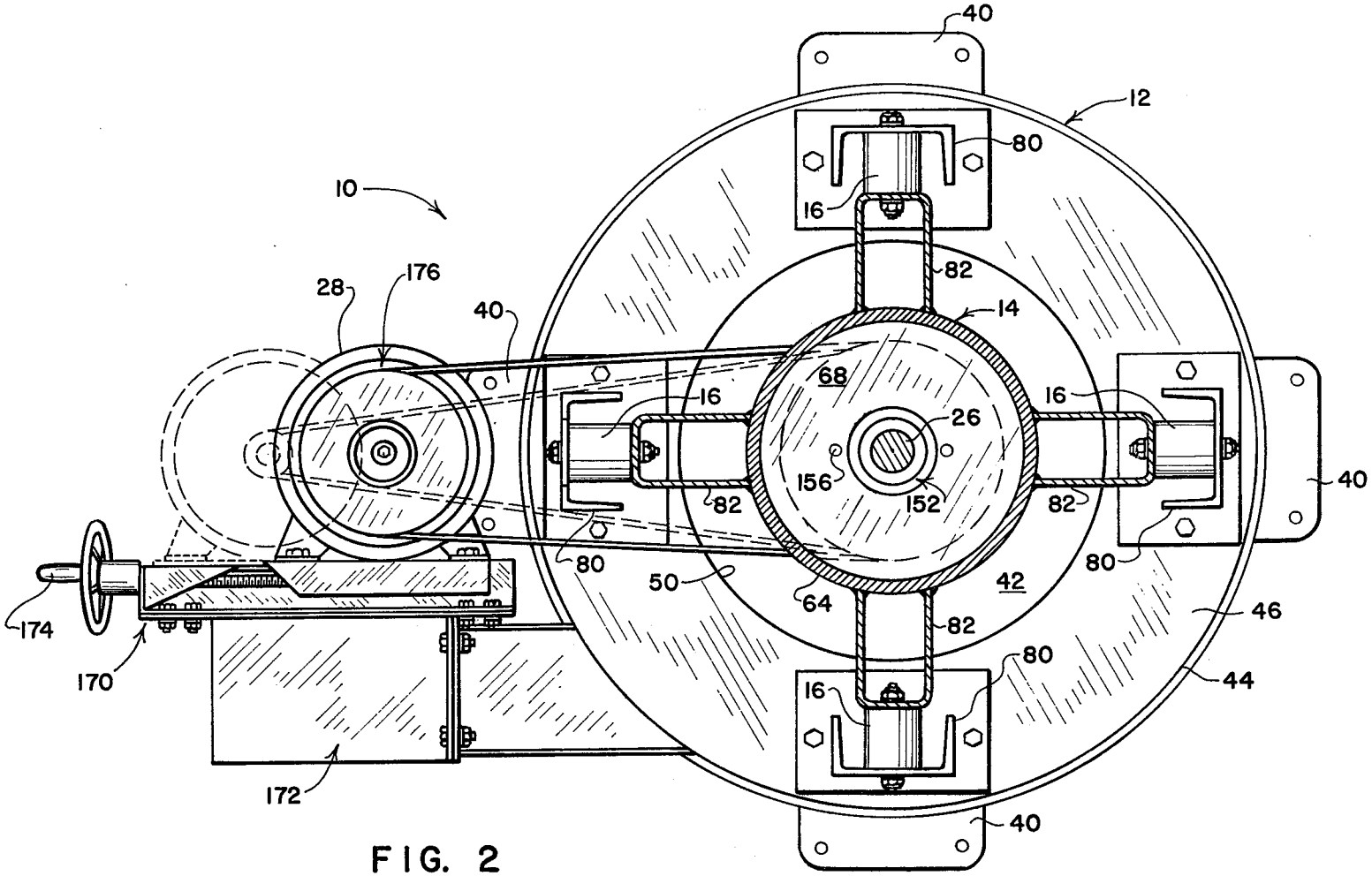
FIG. 2 is a sectional view as seen from a plane indicated by a line 2—2 in FIG. 1.

Referring to FIGS. 1 and 2, a vibratory finishing machine is indicated generally by the numeral 10. The machine 10 includes a base structure 12 and a bowl structure 14. Elastomeric mounts 16 resiliently interconnect the structures 12, 14 and permit relative movement therebetween. A replaceable liner assembly 18 forms part of the bowl structure 14 and defines an annular finishing chamber 20 for receiving media and workpieces to be finished. Vibratory movements are imparted to the bowl structure 14 by a drive system which includes a pair of eccentric weights 22, 24 supported on opposite ends of a rotatable shaft 26, a motor 28, and a belt 30 which drivingly interconnects the shaft 26 and the motor 28.

The machine 10 has a "center axis", indicated by the numeral 32. The center axis 32 is an imaginary vertical line defined by the axis of the shaft 26 when the machine 10 is at rest. The center axis 32 extends substantially coaxially of the trough or chamber 20. During operation of the machine 10, the bowl structure 14 vibrates substantially about a node or null point 34. The node 34 is located at the juncture of the center axis 32 and a horizontally extending "nodal plane" 36. As will be appreciated by those skilled in the art, in actual practice the node or null point 34 is not a mathematical point but rather should be considered to be a small region around the juncture of the center axis 32 and the nodal plane 36. Depending on such variables as the position of the center of gravity of the bowl structure 14 and its contents, the node or null point 34 may be located a small distance above or below the nodal plane 36. Due to a number of factors including the fact that the bowl structure 14 need not be accurately balanced, the actual node or null point 34 may oscillate through small distances about the juncture of the center axis 32 and the nodal plane 36.

The base structure 12 has a welded framework including four feet 40, a bottom wall 42, a side wall 44, a top wall 46, and bracing plates 48. The feet 40 are welded to the underside of the bottom wall 42 and support the machine 10. The bottom wall 42 is a round plate which is perimetrically welded to the side wall 44. The side wall 44 is cylindrical and extends upwardly from the bottom wall 42. The top wall 46 is of annular configuration, is perimetrically welded to the side wall 44, and has a central opening 50. The bracing plates 48 are eight in number and are arranged in a symmetrical, radially extending array between the bottom and top walls 42, 46. The bracing plates 48 are welded to the bottom and top walls 42, 46 to rigidify the framework formed by the bottom, side and top walls 42, 44, 46.

The bowl structure 14 has a welded framework including a bottom wall 60, a side wall 62, an upstanding center tube 64, and a pair of bearing mounting plates 66, 68. The bottom wall 60 is of annular configuration and is perimetrically welded to the side wall 62. The side wall 62 is of cylindrical configuration, extends upwardly from the bottom wall 60, and has a peripherally extending rim 70. The center tube 64 extends centrally through and is welded to the bottom wall 60. An inwardly turned rim 72 is formed on the upper end of the center tube, and the lower end of the center tube depends through the base structure opening 50. The bearing mounting plates 66, 68 are of annular configuration, are welded to the center tube 64, and have central openings 76, 78.

The elastomeric mounts 16 are four in number and interconnect four pairs of base and bowl structure brackets 80, 82. The mounts 16 are located symmetrically about the axis of the center tube 64 and overlie alternate ones of the bracing plates 48. The base structure brackets 80 are secured to the top wall 46 at locations above the bracing plates 48. The bowl structure 82 brackets are welded to the center tube 64.

The mounts 16 are preferably of a type sold by Lord Corporation, Erie, Pennsylvania, 16512, Part Number J5425-4, and have a spring rate of $K_s = 350$ pounds per inch. The mounts 16 have axes which lie in the nodal plane 36 and intersect at the node or null point 34. This arrangement assures that the mounts 16 are loaded in shear by the weight of the bowl structure 14 and its contents, utilizes the relative axial incompressibility of the mounts 16 to help assure that the bowl structure moves only about the node 34, and significantly reduces the sensitivity of the machine to variations in finishing chamber loading.

Inasmuch as the elastomeric mounts 16 oppose movements of the bowl structure that would take their inner ends either above or below the nodal plane 36, the mounts 16 are substantially more effective than compression coil springs and the like in maintaining the actual location of the node 34 in the nodal plane 36. This suspension system characteristic is quite unlike previously proposed suspension systems which do little to assist in maintaining a constant node height to reduce sensitivity to variations in finishing chamber loading.

The bowl liner assembly 18 includes a substantially semi-torroidal shaped floor member 90, an outer extension member 92, and an inner extension member 94. The members 90, 92, 94 are separately molded from a relatively stiff lining material such as urethane elastomer having a hardness of about ninety durometers. An adhesive, liquid sealant is preferably used between abutting surfaces of the members 90, 92, 94 to enhance the formation of fluid-tight seals therebetween once the members are clamped together.

The floor member 90 has a rounded inner wall 96 which extends between coplanar outer and inner rim portions 98, 100. The outer rim portion 98 includes a mounting flange 102 which overlies the side wall rim 70. The inner rim portion 100 is molded to extend slightly above the center tube rim 72 so that it is compressed downwardly when the inner extension member 94 is clamped in place. The floor member 90 has an outer wall 104 which engages the center tube 64 and the side wall 62 only at locations adjacent the rim portions 98, 100. The outer wall 104 is relieved in areas below the rim portions 98, 100 and makes no other contact with the center tube 64 or the side wall 62. The outer wall 104 has a flat bottom surface 114 which engages the bottom wall 60. The relieved configuration of the outer wall 104 facilitates insertion of the liner member 90 into the annular trough defined by the bottom and side walls and the center tube 60, 62, 64, and facilitates the establishment of an effective clamping action which holds the floor member 90 in place.

The outer extension member 92 has an inner wall 120 which curves inwardly and upwardly from the outer rim portion 98, extending the arcuate curve defined by the inner wall 96. Near the top of the extension member 92, the inner wall 120 extends vertically upwardly and terminates in a top surface 122. The outer extension member 92 has a circumferentially extending mounting flange 124 which rests atop the mounting flange 102. A metal ring 126 overlies the mounting flange 124. Threaded fasteners 128 extend through aligned holes formed in the ring 126, in the mounting flanges 124, 102 and in the rim 70 to rigidly connect the liner members 90, 92 to the rim 70. The fasteners 128 clamp the outer extension member 92 downwardly into engagement with the floor member rim portion 98 and cause a fluid tight seal to be formed between the liner members 92, 96.

The inner extension member 94 has an inner wall 130 which curves inwardly and upwardly from the inner rim portion 100, extending the arcuate curve defined by the inner wall 96. Near the top of the extension member 94, the inner wall 130 extends vertically upwardly and terminates in a top surface 132. The inner extension member 94 has a radially inwardly extending mounting flange 134 which rests atop the rim portion 100 and overlies the center tube rim 72. A cover 132 rests atop the mounting flange 134 and closes the open upper end of the center tube 64. Threaded fasteners 138 extend through aligned holes formed in the cover 136 and in the mounting flange 134, and are threaded into holes formed in the center tube rim 72. The fasteners 138 clamp the inner extension member 94 downwardly into engagement with the floor member rim portion 100 and cause a fluid tight seal to be formed between the liner members 94, 96.

A feature of the multi-part liner assembly construction is that it permits individual replacement of the members 92, 94, 96. Since the extension components 92, 94 are subjected to much less abrasive action than the floor component 90, the extension components 92, 94 do not have to be replaced nearly as often as the floor component 90. The novel bolt-together clamping features of the liner assembly wherein two upper liner components are used to securely clamp the lower component provides a system that keeps all three liner components rigidly in place through long periods of service.

The shaft 26 is journaled by two bearing block assemblies 150, 152. The bearing assembly 150 extends through the mounting plate opening 76 and is secured to the mounting plate 66 by threaded fsteners 154. The bearing assembly 152 extends through the mounting plate opening 78 and is secured to the mounting plate 68 by threaded fasteners 156.

A feature of the machine 10 lies in its simplicity of construction and the ease with which it can be serviced. The eccentric 22 is in a readily accessbile location which can be reached by removing nothing more than the cover 136. Access to the upper bearing block 150 is had easily, simply by removing the eccentric 22 from the shaft end 150. Since the upper bearing block 150 is located a substantial distance from the node 34, it takes the majority of the wear and tear. The lower bearing block 152 is located quite near the node 34 and seldom requires service since it carries smaller loads.

The motor 28 is movably supported by a conventional, adjustable motor mount 170. A bracket assembly 172 supports the motor mount 170 and the base structure 12. The mount 170 has a crank 174 which can be turned to move the motor 28 inwardly and outwardly toward and away from the shaft 26. A variable diameter pulley 176 of the type described in the referenced Pulley Patent is supported on the drive shaft of the motor 28. When the motor 28 is at the inward end of its range of travel, the pulley 176 has a relatively large effective outer diameter, as shown in solid lines in FIG. 1. When the motor 28 is at the outward end of its range of travel, the pulley 176 has a relatively small effective outer diameter, as shown in phantom in FIGS. 1 and 2.

A fixed diameter pulley 180 is secured to the lower end region of the shaft 26. The belt 30 is reeved around and drivingly interconnects the pulleys 176, 180. Depending on the position of the motor 28, the belt 30 is operable to drive the shaft at speeds with the range of about 700 to 1450 revolutions per minute.

A feature of the machine 10 is that the pulleys 176, 180 and the drive belt 30 are located in the nodal plane 36. This arrangement minimizes radial movements of the pulley 180 during machine operation and thereby overcomes problems of excessive belt wear, stretching and failure encountered in many previously proposed bowl machines.

The eccentric 22 carries a plurality of removable weights 190 which are held in place by threaded fasteners 192. The weights 190 can be added and removed as required to accommodate exceptionally large or small loads of workpieces and finishing media and to adjust the machine for optimal operation within the loading range most commonly used by a particular customer.

Figure 3:
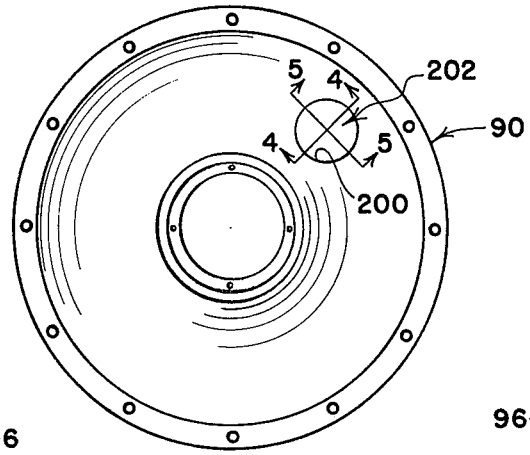
FIG. 3 is a top plan view of a portion of the bowl structure of the machine with portions of the bowl liner assembly removed.

Referring to FIG. 3, an opening 200 is formed through the bottom of the floor member 90. A plug assembly 202 is provided to selectively close the opening 200. While the plug assembly 200 is of solid construction and fully closes the opening 200, it is interchangeable with plug assemblies which are provided with drain openings, as will be described.

Figure 4:
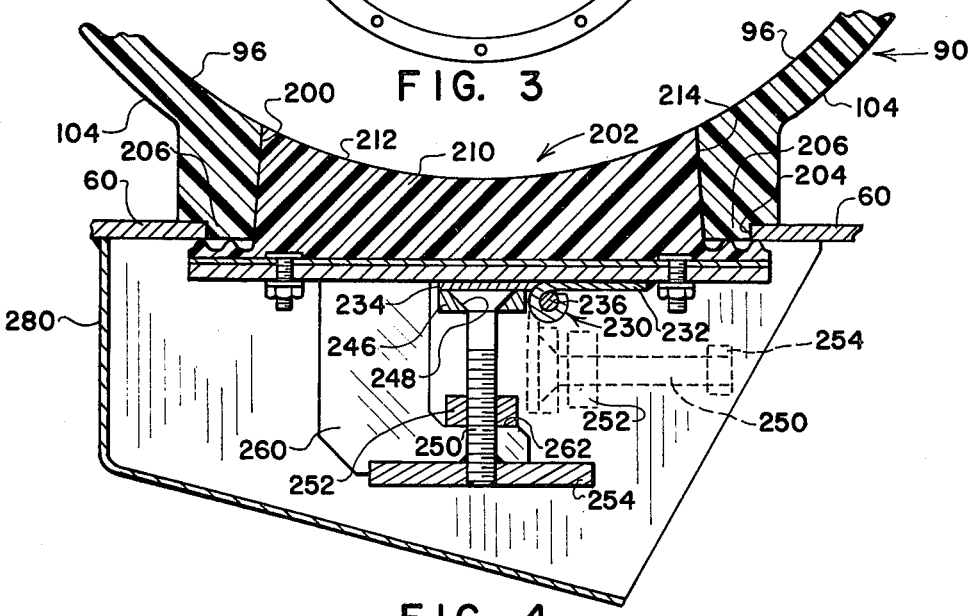
FIGS. 4 and 5 are sectional views as seen from planes indicated by lines 4—4 and 5—5 in FIG. 3.
Figure 5:
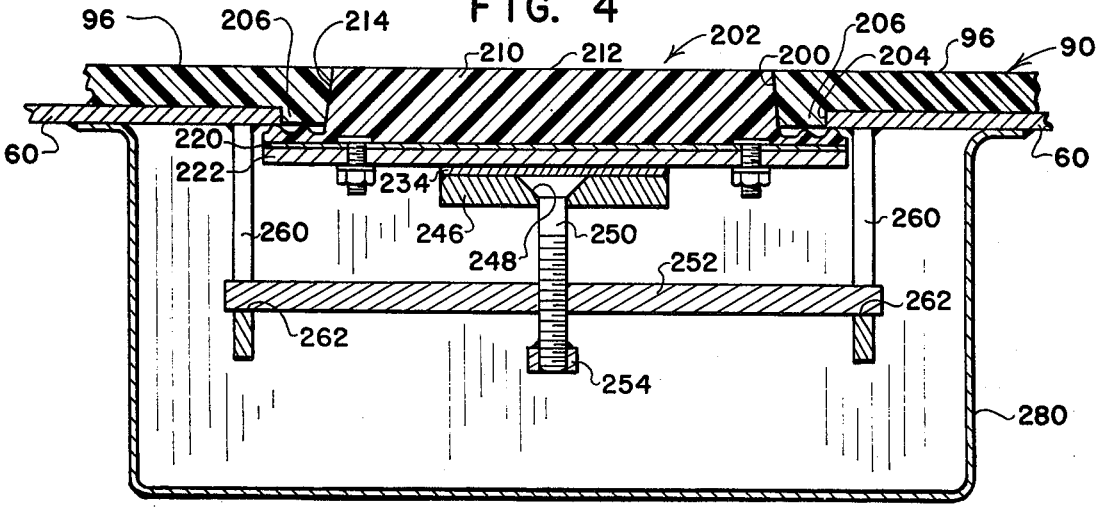

Referring to FIGS. 4 and 5 an opening 204 is formed through the bottom wall 60 in alignment with the floor member opening 202. The floor member 90 has portions 206 which depend through the bottom wall opening 204 and extend flush with the underside of the bottom wall 60. The opening 202 widens in a discharge direction as it extends through the portions 206.

The plug assemblfy 202 includes a molded plug 210 formed from the same material as the floor member 90. The plug 210 has a curved upper surface 212 which forms a smooth continuation of the arcuately curved floor member surface 90. The plug 210 has tapered wall portions 214 configured to seal snugly in the tapered opening 202. The plug also has a radially extending flange 216 with upstanding circular ribs 218 which are adapted to seat against the floor member portions 206 and against such portions of the bottom wall 60 as surround the opening 204.

A mounting plate 220 is securely bonded to the plug 210 during molding of the plug 210. A base plate 222 underlies the mounting plate 220. Threaded fasteners 224 extend through aligned holes formed in the plates 220, 222 and clamp the plates 220, 222 together.

A hinge 230 is positioned beneath the base plate 222. The hinge 230 has plates 232, 234 which are pivotally connected by a pin 236. The hinge plate 232 is welded to the base plate 222. The hinge plate 234 is pivotally movable relative to the hinge plate 232 about the axis of the pin 236.

A bearing plate 246 is welded to the hinge plate 234. A tapered hold 248 is formed through the bearing plate 246. A flat headed bolt 250 is journaled for rotation in the hole 248. The bolt 250 is threaded through a hole formed in a support bar 252 and through a hole formed in a handle 254. The handle 254 is welded to the lower end of the bolt 250.

A pair of L-shaped brackets 260 are welded to the bottom wall 60 at locations on opposite sides of the openings 200, 204. The brackets 260 depend from the bottom wall 60 and provide upwardly facing support surfaces 262. Opposite ends of the support bar 252 rest on the surfaces 262.

The plug assembly 202 is clamped in place by rotating the handle 254 to thread the bolt 250 upwardly through the support bar 252, whereby the plug assembly 202 is forced upwardly and seals the opening 200. The plug assembly 202 is removed by rotating the handle 254 in the opposite direction to thread the bolt 250 downwardly through the support bar 252 causing the support bar 252 to lift off the support surfaces 262 to a position where the bolt 250 and the support bar 252 can be pivoted to the position shown in phantom in FIG. 4. Once the bolt 250 and the support bar 252 have been pivoted in this manner, the plug assembly 202 can be dropped out of the opening 200.

Once the plug structure 202 has been removed from the opening 200, contents of the chamber 20 will discharge through the opening 202. A discharge chute 280 is provided beneath the opening 202 to duct the discharging contents toward a container, not shown, where they are collected.

Figure 6:
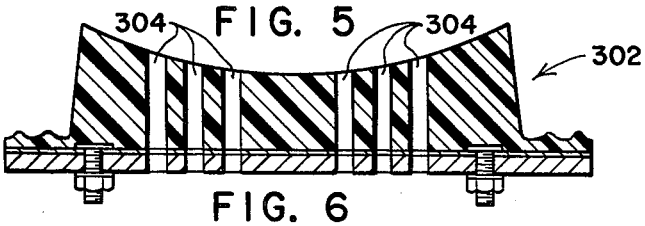
FIG. 6 is a sectional view similar to FIG. 4 of an alternate bowl plug embodiment.

Referring to FIG. 6, other plug structures such as a plug structure 302 can be used in place of the plug structure 202 when it is desired to continually drain liquids or strain fines from the chamber 20. The plug structure 302 is identical in construction to the plug structure 202 except for the provision of a plurality of drain openings 304.

As will be apparent from the foregoing description, the present invention provides a bowl-type machine of simple construction which can be easily serviced and maintained. While the described machine is intended for use primarily with finishing chamber loads having a volume of about 2 to 6 cubic feet, the principles of this invention can be applied to machines having larger and smaller bowl capacities. The use of larger numbers of elastomeric mounts is preferred on larger machines, and the use of "softer" mounts is preferred on smaller machines.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A bowl-type vibratory finishing machine, comprising:

(a) a base structure having a vertical axis with a point thereon referred to as a nodal point;

(b) a bowl structure defining a substantially annular chamber adapted to receive finishing media and workpieces to be finished;

(c) a plurality of elastomeric mounts movably supporting the bowl structure on the base structure, each of the mounts having one portion secured to the bowl structure and another portion secured to the base structure, the one and another portions defining an axis for each mount;

(d) drive means for vibrating the bowl structure relative to the base structure to impart a finishing action to contents of the chamber with the bowl structure moving substantially about the nodal point;

(e) the elastomeric mounts being arranged such that their axes intersect at and extend in a radial array outwardly from the nodal point, whereby the mounts tend to direct movements of the bowl structure around the nodal point relative to the base structure.

2. The bowl-type vibratory finishing machine of claim 1 wherein the elastomeric mounts are arranged with their axes in a substantially common, horizontal plane which includes the nodal point.

3. Th bowl-type vibratory finishing machine of claim 1 wherein the nodal point is located below the chamber, and the elastomeric mounts are located in a circle directly beneath the chamber.

4. The bowl-type vibratory finishing machine of claim 1 wherein the elastomeric mounts are located at substantially equal distances from the nodal point.

5. The bowl-type vibratory finishing machine of claim 1 wherein each of the elastomeric mounts located on one side of the nodal point has a corresponding elastomeric mount located on the opposite side of the nodal point, corresponding mounts being located at equal distances from the nodal point and having common axes.

6. The bowl-type vibratory finishing machine of claim 1 wherein the drive means includes;

(a) a motor supported by the base structure;

(b) eccentric means journaled by the bowl structure for rotation about an axis of rotation which extends through the nodal point; and (c) flexible means drivingly interconnecting the motor and the eccentric means and extending in a plane which includes the nodal point and which is substantially normal to the axis of rotation of the eccentric means.

7. The bowl-type vibratory finishing machine of claim 6 wherein the eccentric means includes a pair of eccentricl weights supported on a shaft which extends along the axis of rotation, one of the weights being located above the nodal point and centrally of the annular chamber, the other of the weights being located below the nodal point.

8. The bowl-type vibrating finishing machine of claim 7 wherein:

(a) the shaft extends substantially vertically;

(b) a pair of vertically spaced bearings are supported by the bowl structure and journal the shaft for rotation;

(c) the lower of the two bearings is located near the nodal point whereby it is subjected to relatively small forces during operation of the drive means;

(d) the upper of the two bearings is located substantially farther from the nodal point whereby it is subjected to relatively larger forces during operation of the drive means; and (e) the bowl structure has a removable cover providing ready access to the upper bearing for service and replacement of the upper bearing.

9. The bowl-type vibratory finishing machine of claim 7 wherein:

(a) the bowl structure includes a substantially cylindrical tube which extends coaxially of the rotation axis and within which the weights are journaled for rotation;

(b) a removable cover closes the upper end of the tube, whereby the cover and the tube shield the upper of the weights; and (c) the base structure surrounds the open lower end of the tube, whereby the base structure and the tube shield the lower of the weights.

10. The bowl-type vibratory finishing machine of claim 1 wherein the base structure includes upstanding formation means disposed substantially within a first circle having its center at the nodal point, the bowl structure has depending formation means disposed substantially within a second circle having its center at the nodal point, and the elastomeric mounts are interposed between and secured to the upstanding and depending formation means.

11. The bowl-type vibratory finishing machine of claim 10 wherein the second circle has a lesser diameter than the first circle.

12. The bowl-type vibratory finishing machine of claim 1 wherein the bowl structure includes a welded assembly of inner and outer cylindrical walls connected by a bottom wall, the drive means for vibrating the bowl structure relative to the base structure being mounted within the inner wall, the walls cooperating to define an upwardly opening substantially annular trough, and resilient liner means is removably supported in the trough and defines the annular chamber.

13. The bowl-type vibratory finishing machine of claim 12 wherein the liner means includes a lower semi-torroidal-shaped member, having outer and inner peripheries located in a substantially common horizontal plane, an outer rim member supported atop the outer periphery of the lower member, and inner rim member supported atop the inner periphery of the lower member, and clamping means clamping the outer and inner rim members into fluid-tight engagement with the outer and inner peripheries of the lower member.

14. The bowl-type vibratory finishing machine of claim 13 wherein the rim members are formed from rigid plastic material and are supported solely by the clamping means.

15. The bowl-type vibratory finishing machine of claim 12 wherein the liner means is formed from rigid plastic and makes engagement with the welded assembly in only three areas, the first area being along a circle which extends centrally along the top side of the bottom wall, the second being near the upper rim of the outer wall, and the third being near the upper rim of the inner wall, the inner means being relieved at other locations to minimize contact with the welded assembly and to thereby reduce the magnitude of frictional forces which are encurred in inserting the liner means into and removing the liner means from the annular trough.

16. The bowl-type vibratory finishing machine of claim 1 wherein the elastomeric mounts are located in a circle about the nodal point and beneath the chamber, and a discharge opening is provided in the bowl structure communicating with the chamber at a location between two of the mounts.

17. The bowl-type vibratory finishing machine of claim 16 additionally including closure means for closing at least a portion of the discharge opening.

18. The bowl-type vibratory finishing machine of claim 17 wherein the closure means is provided with holes for continually draining liquids and small contents from the chamber.

19. A bowl-type vibratory finishing machine, comprising:

(a) a base structure;

(b) a bowl structure defining a substantially annular chamber adapted to receive finishing media and workpieces to be finished;

(c) mounting means for movably mounting the bowl structure on the base structure;

(d) drive means for vibrating the bowl structure relative to the base structure to impart a finishing action to contents of the chamber;

(e) the bowl structure including:

(i) support means defining an upwardly opening annular trough around the chamber;

(ii) a resilient liner member of substantially semi-torroidal shape positioned in the annular trough and having an outer rim part, an inner rim part and a continuous, curved surface which extends between the outer and inner rim parts to define at least a portion of the chamber;

(iii) clamping means for clamping the outer and inner rim parts to the support means to securely mount the liner member in the annular trough, the clamping means including a rim structure which overlies an associated one of the inner and outer rim parts, and fastener means for clamping the associated rim part between portions of the rim structure and the support means; and, (iv) the rim structure having an inner wall surface which defines a portion of the annular chamber.

20. The bowl-type vibratory fnishing machine of claim 19 wherein the rim structure overlies the outer rim part, and the fastener means clamps the outer rim part between portions of the rim structure and the support means.

21. The bowl-type vibratory finishing machine of claim 19 wherein the rim structure overlies the inner rim part, and the fastener means clamps the inner rim part between portions of the rim structure and the support means.

22. A bowl-type vibratory finishing machine, comprising:

(a) a base structure;

(b) a bowl structure defining a substantially annular chamber adapted to receive finishing media and workpieces to be finished;

(c) mounting means for movably mounting the bowl structure on the base structure;

(d) drive means for vibrating the bowl structure relative to the base structure to impart a finishing action to contents of the chamber;

(e) the bowl structure including:

(i) support means defining an upwardly opening annular trough around the chamber;

(ii) a resilient liner member of substantially semi-torroidal shape positioned in the annular trough and having an outer rim part, an inner rim part and a continuous, curved surface which extends between the outer and inner rim parts to define at least a portion of the chamber;

(iii) clamping means for clamping the outer and inner rim parts to the support means to securely mount the liner member in the annular trough, the clamping means including resilient outer and inner rim structures having inner wall portions which define a part of the chamber, the outer and inner rim structures being supported, respectively, atop the outer and inner rim parts, and fastener means for clamping the outer and inner rim structures against the outer and inner rim parts to establish fluid-tight seals therebetween.

23. A bowl-type vibratory finishing machine, comprising:

(a) an upstanding base structure;

(b) a bowl structure having a substantially cylindrical center tube and trough means secured to the center tube and extending outwardly therefrom, the trough means cooperating with the center tube to define an annular, open-top trough;

(c) a resilient liner member removably carried in the trough and defining a substantially annular upwardly opening chamber adapted to receive finishing media and workpieces to be finished, the liner member having an inner rim, an outer rim, and a curved wall connecting the rims;

(d) mounting means movably mounting the bowl structure on the base structure;

(e) drive means for vibrating the bowl structure relative to the base structure to impart a finishing action to contents of the chamber;

(f) inner clamping means clamping the inner rim of the liner member to the center tube;

(g) outer clamping means clamping the outer rim of the liner member to the trough means; and (h) one of the inner and outer clamping means including resilient structure which extends upwardly from its associated rim, and having an inner wall which forms a continuation of the curved wall.

24. The bowl-type vibratory finishing machine of claim 23 wherein the base structure defines an open-top receptacle, and the center tube has a lower end region which depends into the receptacle.

25. The bowl-type vibratory finishing machine of claim 23 wherein the resilient liner member contacts the center tube solely in the vicinity of the inner rim.

26. The bowl-type vibratory finishing machine of claim 23 wherein the trough means includes an upstanding outer wall which surrounds portions of the center tube at a substantially constant distance from the outer surface of the center tube, and the resilient liner member contacts the outer wall solely in the vicinity of the outer rim.

27. The bowl-type vibratory finishing machine of claim 23 wherein the outer clamping means includes resilient structure which extends upwardly from the outer rim and has an inner wall which forms a continuation of the curved wall.

28. The bowl-type vibratory finishing machine of claim 23 wherein the inner clamping means includes cover means which overlies an upper end portion of the center tube.

29. The bowl-type vibratory finishing machine of claim 23 wherein the mounting means includes a plurality of elastomeric mounts interposed between the bowl structure and the base structure.

30. The bowl-type vibratory finishing machine of claim 29 wherein each of the elastomeric mounts has one portion secured to the bowl structure and another portion secured to the base structure, the one and another portions defining an axis for each mout, and the mount axes intersect at a substantially common point.

31. The bowl-type vibratory finishing machine of claim 30 wherein the drive means is operable to vibrate the bowl structure substantially about the common point.

32. The bowl-type vibratory finishing machine of claim 31 wherein the mount axes and the common point are located substantially in a common plane.

33. A bowl-type vibratory finishing machine, comprising:

(a) a base structure having a vertical center axis with a point therein referred to as a nodal point and support formations extending upwardly from the base structure at locations on the circumference of a circle which is concentric with the center axis;

(b) a bowl structure including a center tube positioned about the center axis and having mounting formations extending radially outwardly therefrom toward the support formations;

(c) a plurality of elastomeric mounts interposed between the mounting formations and the support formations and movably mounting the bowl structure on the base structure;

(d) the bowl structure additionally including chamber defining means supported by the center tube and defining a continuous chamber around the center tube for receiving finishing media and workpieces to be finished; and (e) drive means for vibrating the bowl structure relative to the base structure substantially about the nodal point.

34. The bowl-type vibratory finishing machine of claim 33 wherein each of the elastomeric mounts has one portion secured to a selected one of the support formations, and another portion secured to a selected one of the mounting formations, the one and another portions defining an axis of each mount, and the mount axes intersecting at a common point along the center axis.

35. The bowl-type vibratory finishing machine of claim 34 wherein the common point coincides with the nodal point.

36. The bowl-type vibratory finishing machine of claim 35 wherein the mount axes lie in a common plane with the nodal point.

37. The bowl-type vibratory finishing machine of claim 35 wherein the drive means includes eccentric means journaled by the bowl structure at a location within the center tube for rotation about the center axis, a drive motor carried by the base structure, and flexible connection means extending in a common plane and drivingly connecting the drive motor and the eccentric means.

38. The bowl-type vibratory finishing machine of claim 33 wherein the chamber defining means includes a substantially semi-torroidal shaped resilient liner member removably supported about the center tube and defining at least a lower portion of the chamber.

39. The bowl-type vibratory finishing machine of claim 38 wherein the chamber defining means additionally includes resilient wall structure positioned atop the liner member, and clamping means clamping the wall structure and the liner member together to form a fluid-tight seal therebetween 40. The bowl-type vibratory finishing machine of claim 38 wherein a discharge opening is formed through the bottom of the liner member, and closure structure is supported by the chamber defining means for selectively closing at least a portion of the discharge opening.

41. The bowl-type vibrator finishing machine of claim 40 wherein the closure structure is provided with holes therethrough for continually draining liquids and small contents from the chamber.

42. A bowl-type vibratory finishing machine, comprising:

(a) an upstanding base structure;

b. a bowl structure defining a substantially annular chamber adapted to receive finishing media and workpieces to be finished;

(c) a plurality of elastomeric mounts supporting the bowl structure for movement relative to the base structure, the mounts each having one end secured to the base structure and the other end secured to the bowl structure, the mounts being relatively incompressible and inextensible under the influence of compression and tension forces, each mount having an axis which extends through its one and other ends, the mounts being arranged such that their axes lie in a common plane said plane having a point therein referred to as a null point;

(d) drive means for vibrating the bowl structure relative to the base structure to impart a finishing action to the contents of the chamber with the bowl structure moving substantially about the null point in the common plane; and, (e) mounting means arranging and supporting the mounts for utilization of the relatively incompressible and inextensible nature thereof to stabilize the location of the null point as the bowl structure vibrates relative to the base structure.

43. The bowl-type vibratory finishing machine of claim 42 wherein the drive means includes a motor supported by the base structure, eccentric means journaled by the bowl structure for rotation about an axis of rotation which intersects the null point, and flexible means which extends in the common plane for drivingly connecting the motor and the eccentric means.

44. The bowl-type vibratory finishing machine of claim 42 wherein the elastomeric mounts are arranged with their axes intersecting at the null point.

45. The bowl-type vibratory finishing machine of claim 42 wherein the elastomeric mounts are located at substantially equal distances from the null point.

46. The bowl-type vibratory finishing machine of claim 42 wherein each of the elastomeric mounts located on one side of the axis of rotation has a corresponding elastomeric mount on the opposite side of the axis of rotation.

47. The bowl-type vibratory finishing machine of claim 46 wherein corresponding mounts are located along common mount axes.

* * * * *